United States Patent [19]

Wright

[11] 4,328,969

[45] May 11, 1982

[54] GOLF TEE

[76] Inventor: Edwin S. Wright, 10614 Riverside Dr., North Hollywood, Calif. 91602

[21] Appl. No.: 191,362

[22] Filed: Sep. 29, 1980

[51] Int. Cl.[3] ..... A63B 57/00

[52] U.S. Cl. ..... 273/203

[58] Field of Search ..... 273/33, 202, 203, 208, 273/209, 211, 212

[56] References Cited

U.S. PATENT DOCUMENTS

| | | | |
|---|---|---|---|
| 2,074,519 | 3/1937 | Shephard | 273/203 |
| 2,107,706 | 2/1938 | Morgan | 273/203 |
| 2,451,311 | 10/1948 | Andersen, Sr. | 273/33 |
| 2,555,222 | 5/1951 | Coleman et al. | 273/203 |

*Primary Examiner*—Richard C. Pinkham
*Assistant Examiner*—T. Brown
*Attorney, Agent, or Firm*—Roger A. Marrs

[57] ABSTRACT

A golf tee is disclosed herein having an elongated shaft formed with a tapered and pointed end intended to be forcibly inserted into the ground. The opposite end of the shaft is provided with a double headed cup arrangement for supporting a conventional golf ball. Each cup is formed with a hemispherical surface corresponding to the contour of a golf ball. The apex or center of one such surface lying on the longitudinal axis of the shaft and the other such surface having its apex or center at a forty-five degree angle with respect to the longitudinal axis of the shaft.

4 Claims, 3 Drawing Figures

GOLF TEE

BACKGROUND OF THE INVENTION

1. Field of the Invention

The present invention relates to golf tees and more particularly, to a novel golf tee having a double headed arrangement for supporting a conventional golf ball in elevated position above the ground.

2. Brief Description of the Prior Art

In the past, it has been the conventional practice in the game of golf to support a golf ball on a tee so that the ball will be in position for striking by the golf club when it is swung by a player. Conventional golf tees include a cup-like head carried on a pointed shaft which is forcibly impressed into the ground so that the cup-like portion provides a solid seat for the ball during the course of play. For inserting the tee into the ground, the player normally places the shaft of the tee between the first two fingers and places his thumb on the cup-like portion or head and forces the tee into the ground. This sometimes causes a discomfort to the thumb or skin of the player and after repeated insertions, the thumb may become tender or sore. Also, great stress is sometimes placed on the shaft of the tee as it is inserted since the shaft is relatively long and where the ground is particularly hard, breakage oftentimes occurs which destroys any further use of the tee. Other problems and difficulties are encountered with conventional tees which affect to some degree the club head striking the ball. Some resistance of the tee is encountered which adversely affects the club passing across the tee. Therefore, the player's swing is adversely affected.

Therefore, a long standing need has existed to provide a novel support for a golf ball which may be readily inserted into the ground without breakage or discomfort to the player and which will readily support the golf ball so as to readily permit the club head to strike the ball.

SUMMARY OF THE INVENTION

Accordingly, the above problems and difficulties are obviated by the present invention which provides a novel golf tee which incorporates an elongated shaft provided with a tapered and pointed end intended to be forcibly inserted into the ground. The opposite end of the shaft is provided with a double headed cup-like arrangement for selectively supporting a conventional golf ball. Each cup of the arrangement is formed with a hemispherical surface corresponding to the contour of a golf ball so that when the tee is inserted into the ground, a central axis is established between the center of the ball and the center or apex of the selected hemispherical surface. The double headed cup-like arrangement includes a pair of thickened mounts which support the hemispherical surfaces and one of the surfaces is arranged in coaxial relationship with the shaft and has its apex line on the longitudinal axis thereof. The other such cup-like hemispherical surface has its center or apex arranged at a forty-five degree angle with respect to the longitudinal axis of the shaft. Therefore, the tee may be inserted in a conventional manner so that the shaft is in a vertical orientation or the shaft may be inserted at a forty-five degree angle and in either position, a cup-like hemispherical surface is available for supporting a golf ball.

Therefore, it is among the primary objects of the present invention to provide a novel tee for supporting a golf ball which includes a double headed cup-like arrangement offering a choice of one supporting head for the ball so that the shaft of the tee may be inserted vertically or angularly at the discretion of the player.

Another object of the present invention is to provide a novel golf tee which resists breakage by providing a thumb press point on the shank of the tee for forcibly urging the shaft of the tee into the ground at a suitable angle.

Still a further object of the present invention is to provide a novel golf tee which permits the player to employ a smooth glide path for his club to the ball so that there is no resistance to the club.

Yet another object of the present invention is to provide a golf tee composed of wood or plastic which includes two cup-like heads selectively arranged for supporting a golf ball whereby the shaft of the tee may be vertically inserted into the ground or may be inserted at a substantially forty-five degree angle to vertical.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings, in which:

DESCRIPTION OF THE PREFERRED EMBODIMENT

Figure 1:
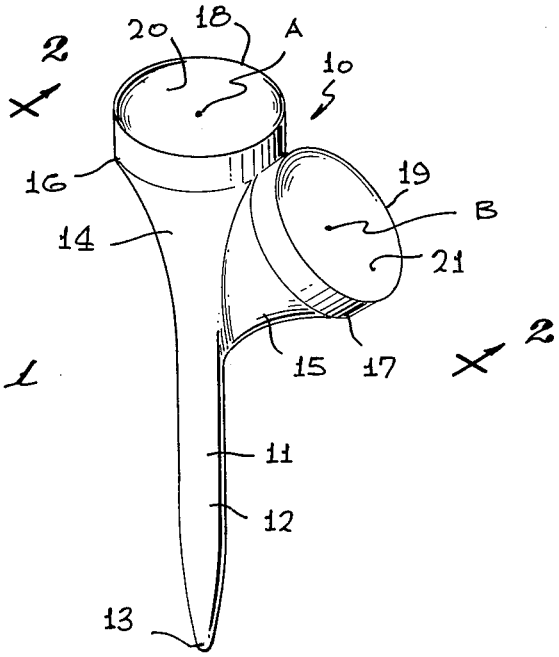
FIG. 1 is a perspective view of the novel golf tee incorporating the present invention.

Referring to FIG. 1, the novel golf tee of the present invention is shown in the general direction of arrow 10 which includes an elongated shaft 11 having a tapered end 12 which terminates in a point 13 so that the tee may be forcibly inserted into the ground. The opposite end of the shaft from its tapered end 12 is provided with a double headed golf ball support arrangement indicated by numerals 14 and 15 respectively. Each head 14 and 15 is a thickened portion formed by outwardly diverging exterior surface of shaft 11 so as to provide a support for a golf ball. Each of the portions 14 and 15 terminate in a shoulder 16 and 17 respectively, having a circular edge 18 and 19 which defines the outer edge of a hemispherical surface indicated respectively by numerals 20 and 21. It is to be particularly noted that the thickened portion 15 is carried on one side of the thickened portion 14 so that the circular edge 19 is at an angle with respect to the circular edge 18.

Figure 2:
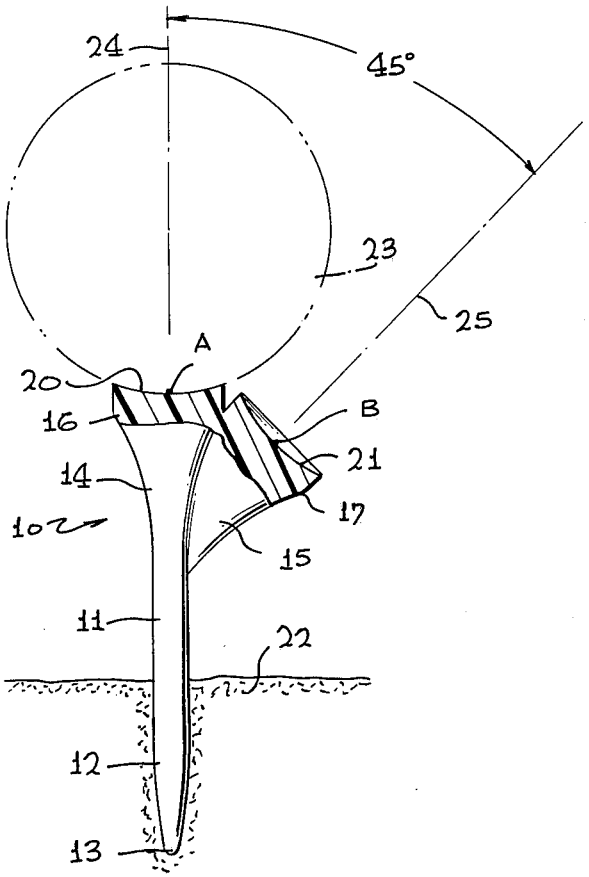
FIG. 2 is a side elevational view, partly in section, of the novel golf tee shown in FIG. 1 as taken in the direction of arrows 2—2 thereof.

Referring now in detail to FIG. 2, it can be seen that the novel golf tee 10 has been inserted into the ground 22 so that its shaft 11 is in a vertical disposition so as to present concave or hemispherical surface 20 for supporting a golf ball 23. The curvature of the surface 20 corresponds to the curvature of the ball 23 and is of sufficient diameter to adequately support the ball 23. As illustrated in FIG. 2, the shaft 11 of the golf tee is inserted in a conventional manner so that the longitudinal axis of the shaft 11 passes through the apex or center of the concave surface as indicated at point A. During insertion, the player's thumb is normally placed on the surface 20 and the shaft 11 is forcibly urged into the earth 22 at its tapered and pointed end. The enlarged double headed cup-like arrangement permits easy withdrawing of the shaft 11 from the ground since the player's first and second fingers can readily grasp the thickened portions 14 and 15 during the whole procedure for withdrawal of the tee.

FIG. 2 also illustrates that the apex or center of surface 21 carried on the thickened portion 15 is identified by letter B and that this center lies on an axis which is at a forty-five degree angle with respect to the longitudinal axis of the shaft 11. The forty-five degree angle is illustrated in the drawings between the diverging lines represented by numerals 24 and 25 respectively.

Figure 3:
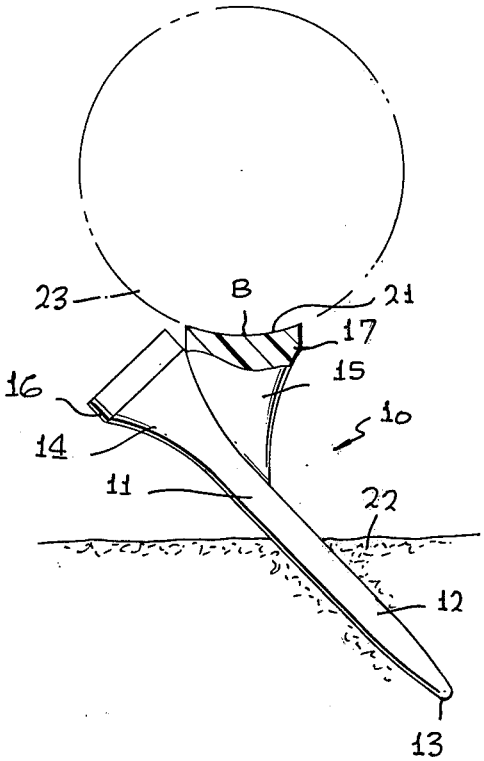
FIG. 3 is a view similar to the view of FIG. 2, illustrating the tee inserted at an angle.

Referring now to FIG. 3 in detail, it can be seen that the novel golf tee 10 has been inserted so that the shaft 11 is at an angle to vertical. In this configuration, the cup-like enlarged portion 15 carrying support surface 21 is available for receiving and holding the ball 23. For insertion, the user places his thumb against the surface 20 associated with thickened portion 14 and forcibly urges the shaft 11 via its pointed and tapered end into the ground. The axis of the circular thickened portion 15 including the circular shoulder 17 is now vertically aligned with respect to the ground 22 and the longitudinal axis of the shaft 11 is angularly disposed. In this manner, breakage is resisted when inserting the tee into the ground and the tee provides a smooth glide path for the club to ball travel and no resistance is encountered by the club.

While particular embodiments of the present invention have been shown and described, it will be obvious to those skilled in the art that changes and modifications may be made without departing from this invention in its broader aspects, and therefore, the aim in the appended claims is to cover all such changes and modifications as fall within the true spirit and scope of this invention.

What is claimed is:

1. A golf tee comprising the combination of:

a single, elongated shaft having one end which is tapered to terminate in a point;

said shaft having an opposite end which is provided with a double-headed cup-like arrangement for selectively supporting a golf ball;

each of said cup-like arrangements having a concave surface for supporting a golf ball;

a selected one of said concave surfaces having its center lying on the central longitudinal axis of said shaft and said other concave surface having its center lying on an axis angularly displaced thereto;

said double headed cup-like arrangement includes a pair of thickened portions integral with said shaft and each portion having a central axis;

the central axis of one of said portions lying on and concentric with the central axis of said shaft and the central axis of the other of said portions lying at a 45 degree angle to the central axis of said shaft;

a selected one of said thickened portions supports a golf ball; and the other of said thickened portions adapted to receive and transfer insertion loads into said shaft during an implanting procedure of said shaft into the ground.

2. The invention as defined in claim 1 wherein:

each of said thickened portions includes an exposed concave surface and each surface having an apex lying on the central axis of its respective thickened portion.

3. The invention as defined in claim 2 wherein:

each of said thickened portions of said double headed cup-like arrangement includes an annular shoulder at its free end having a circular edge defining said concave surface.

4. The invention as defined in claim 3 wherein:

said other of said thickened portions is said portion having its central axis lying on the central axis of said shaft.

* * * * *